US006442107B1

(12) United States Patent
Takagi

(10) Patent No.: US 6,442,107 B1
(45) Date of Patent: Aug. 27, 2002

(54) LUMINOUS WRISTWATCH

(75) Inventor: Yoshiro Takagi, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 09/553,937

(22) Filed: Apr. 21, 2000

(30) Foreign Application Priority Data

Apr. 23, 1999 (JP) ..... 11-002766

(51) Int. Cl.[7] ..... G04B 37/00
(52) U.S. Cl. ..... 368/226; 368/282
(58) Field of Search ..... 368/281, 282

(56) References Cited

U.S. PATENT DOCUMENTS 4,130,987 A * 12/1978 Schickedanz ..... 368/29
5,214,624 A * 5/1993 Siebrasse ..... 368/82
5,418,760 A * 5/1995 Kawashima et al. ..... 368/69
5,746,501 A * 5/1998 Chien ..... 638/282

* cited by examiner

*Primary Examiner*—Bernard Roskoski
(74) *Attorney, Agent, or Firm*—Price and Gess

(57) ABSTRACT

A luminous wristwatch capable of exhibiting a sense of play and ensuring safety of a wearer of the wristwatch. The luminous wristwatch includes a watch face and a belt member each provided thereon with a plurality of light emitters which carry out luminescence upon feeding of electricity thereto. The watch face and belt member each are formed to be light-permeable so that luminescence of the light emitters may be externally visible therethrough. Also, the luminous wristwatch includes a watch body which is provided with an operation button and a control section for controlling on-off operation of the light emitters upon operation of the operation button.

23 Claims, 7 Drawing Sheets

LUMINOUS WRISTWATCH

This invention relates to a light-emitting or luminous wristwatch, and more particularly to a wristwatch including a light-emitting element that can exhibit a novel visual effect.

DESCRIPTION OF RELATED ART

There has been conventionally provided a wristwatch including a lighting device which permits time displayed on the wristwatch to be visible even at the night.

However, the lighting device exhibits only a practical-centered function of lightening a watch face, so that the wristwatch fails to exhibit a sense of play.

SUMMARY OF THE INVENTION

The present invention has been made in view of the foregoing disadvantage of the prior art.

Accordingly, it is an object of the present invention to provide a luminous wristwatch which is capable of exhibiting a sense of play.

It is another object of the present invention to provide a luminous wristwatch which is capable of ensuring safety of a wristwatch wearer during walking or the like in the night.

In accordance with the present invention, a luminous wristwatch is provided. The luminous wristwatch includes a watch body, a watch face and a belt or wrist band member. The watch face and belt member each are provided with a plurality of light emitters which emit light upon feeding of electricity thereto. Also, the watch face and belt member each are formed to be light-permeable so that light emitted from the light emitters may be externally observed therethrough. The watch body is provided thereon with an operation button and a control section for controlling on-off operation of the light emitters upon operation of the operation button.

In a preferred embodiment of the present invention, the watch body is provided with a sensor for detecting vibration applied to the wristwatch and/or inclination thereof and a control button for rendering the sensor effective. The control section controls on-off operation of the light emitters depending on the vibration and/or inclination during operation of the control button.

In a preferred embodiment of the present invention, the light emitters each are constituted by an electroluminescent material. This permits display of a pattern or design of any desired configuration.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE EMBODIMENT

Now, a luminous wristwatch according to the present invention will be described with reference to the accompanying drawings.

Figure 1:
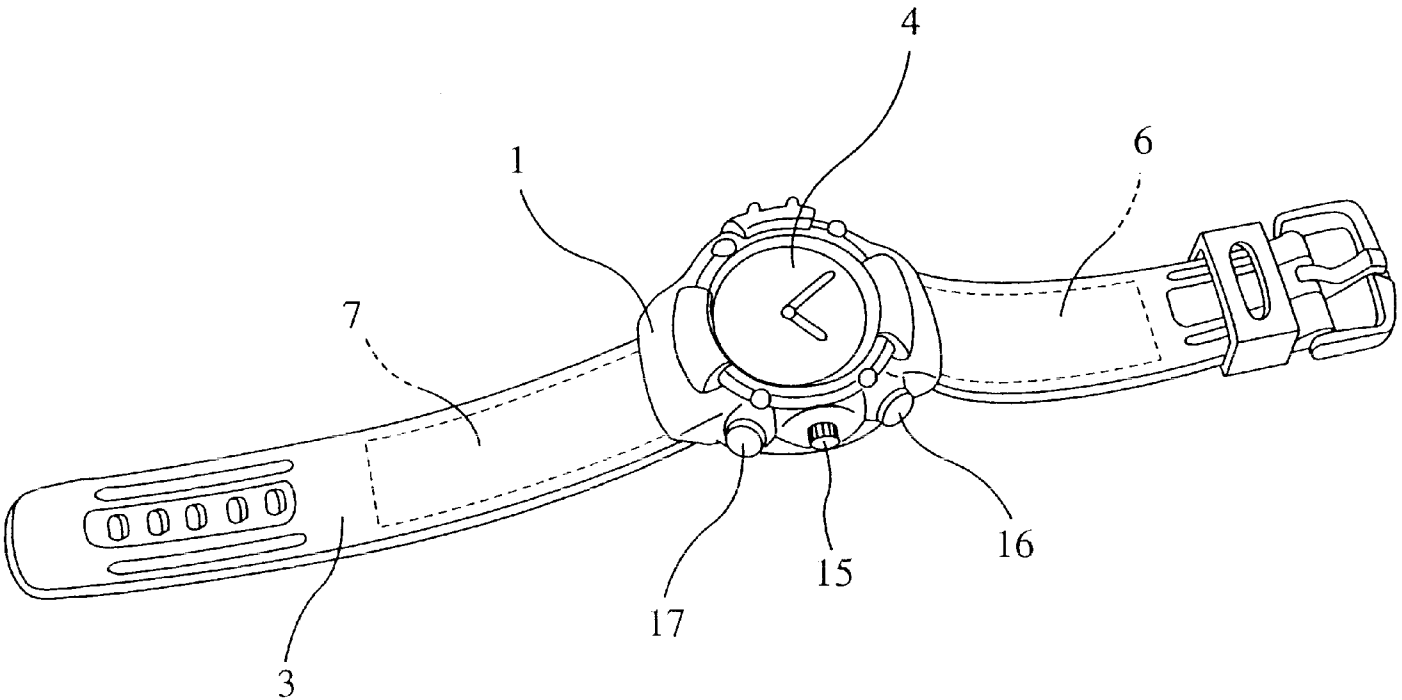
FIG. 1 is a schematic perspective view showing an embodiment of a luminous wristwatch according to the present invention.
Figure 2:
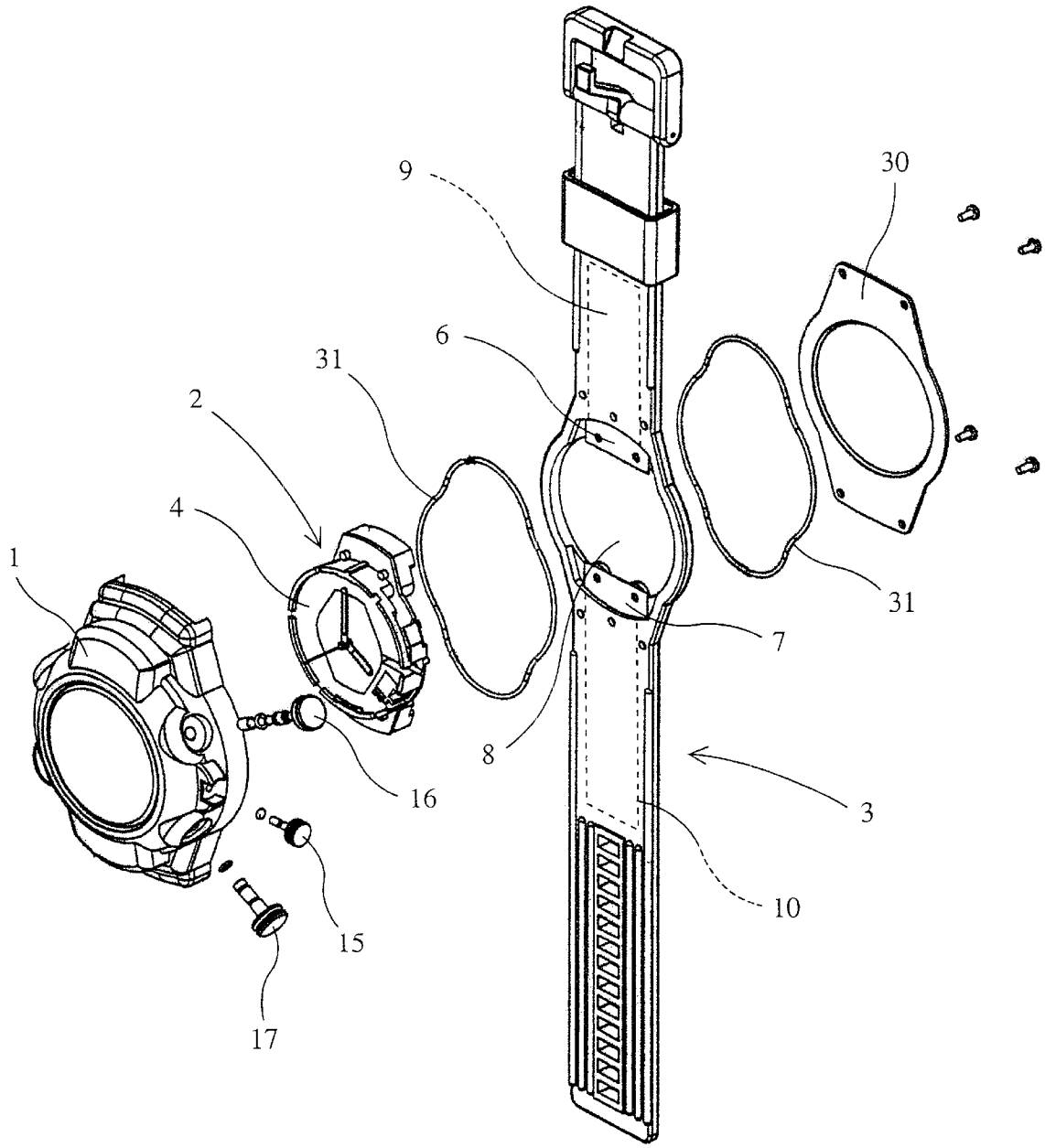
FIG. 2 is an exploded perspective view of the luminous wristwatch shown in FIG. 1.

Referring first to FIGS. 1 and 2, an embodiment of a wristwatch according to the present invention is illustrated. A wristwatch of the illustrated embodiment includes a watch body 1 made of a semi-transparent synthetic resin material such as polyethylene or the like, a mechanical unit 2 arranged in the watch body 1, and a belt member or wrist band 3 through which the wristwatch is fitted on the arm of a wearer. The mechanical unit 2 may be constructed in a manner known in the art. The luminous wristwatch of the illustrated embodiment also includes a watch face 4, which is provided on a rear surface thereof with light emitters a. The belt member 3 is provided therein with strip-like flexible panels 6 and 7, each of which includes light emitters a constituted of, for example, an electroluminescent material or the like.

Figure 3:
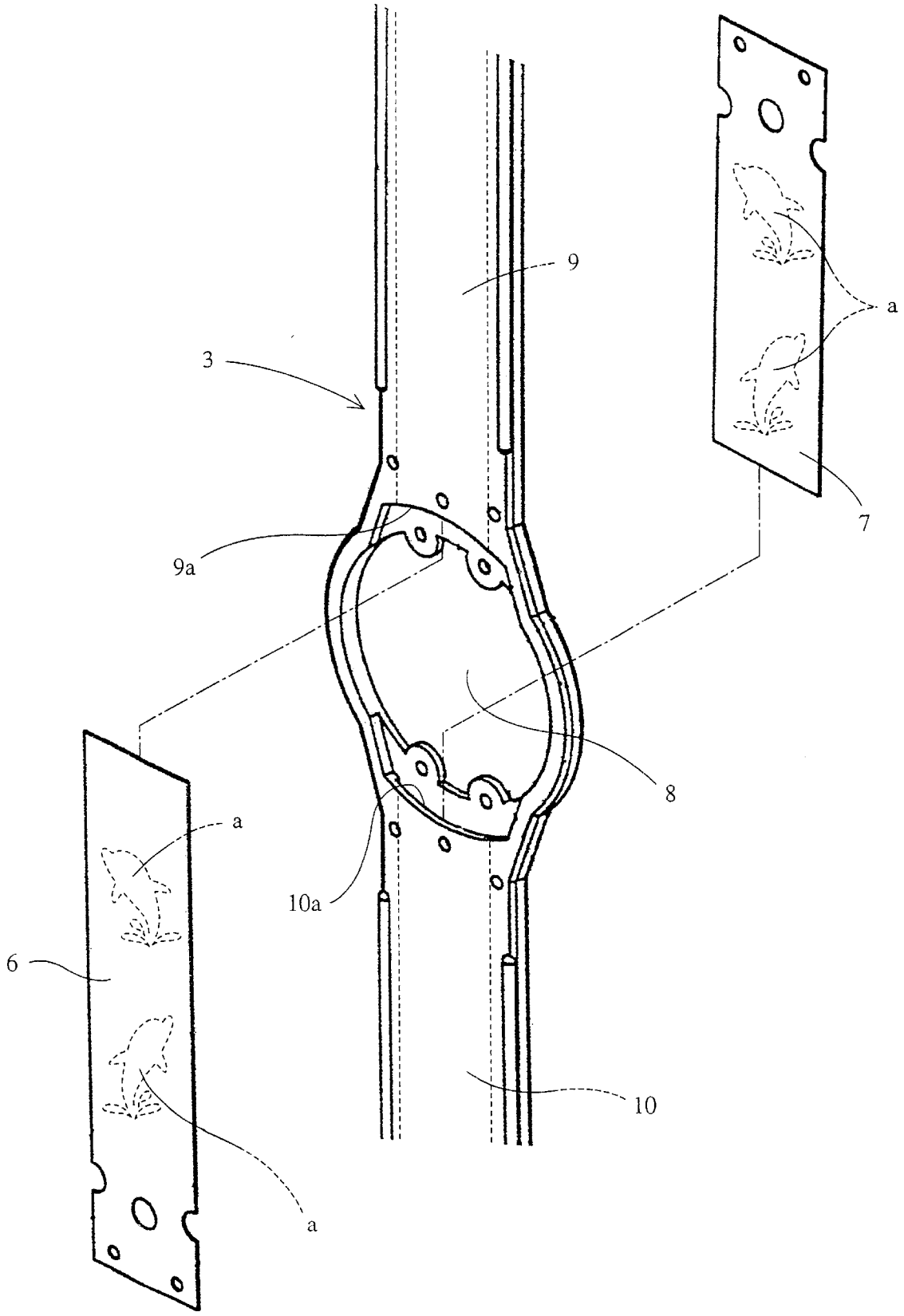
FIG. 3 is a perspective view showing an exploded relationship between flexible panels and a belt member in the luminous wristwatch of FIG. 1.

The belt member 3 is made of a flexible semi-transparent synthetic resin material and is formed at a central portion thereof with an opening 8. Also, the belt member 3 is formed therein with slits 9 and 10, in which the flexible panels 6 and 7 are arranged, respectively. The slits 9 and 10 have ends 9*a* and 10*a* formed so as to be open to an inner peripheral surface of the opening 8, so that the flexible panels 6 and 7 may be inserted through the opening 8 into the slits 9 and 10, respectively, as shown in FIGS. 2 and 3.

The watch body 1 has an operation button 16 and a control button 17 arranged on one side thereof, with a winding crown 15 for adjusting time being interposedly arranged between the operation button 16 and the control button 17. The operation button 16 is constituted by a pushbutton and the control button 17 is constituted by a pull button.

Figure 4:
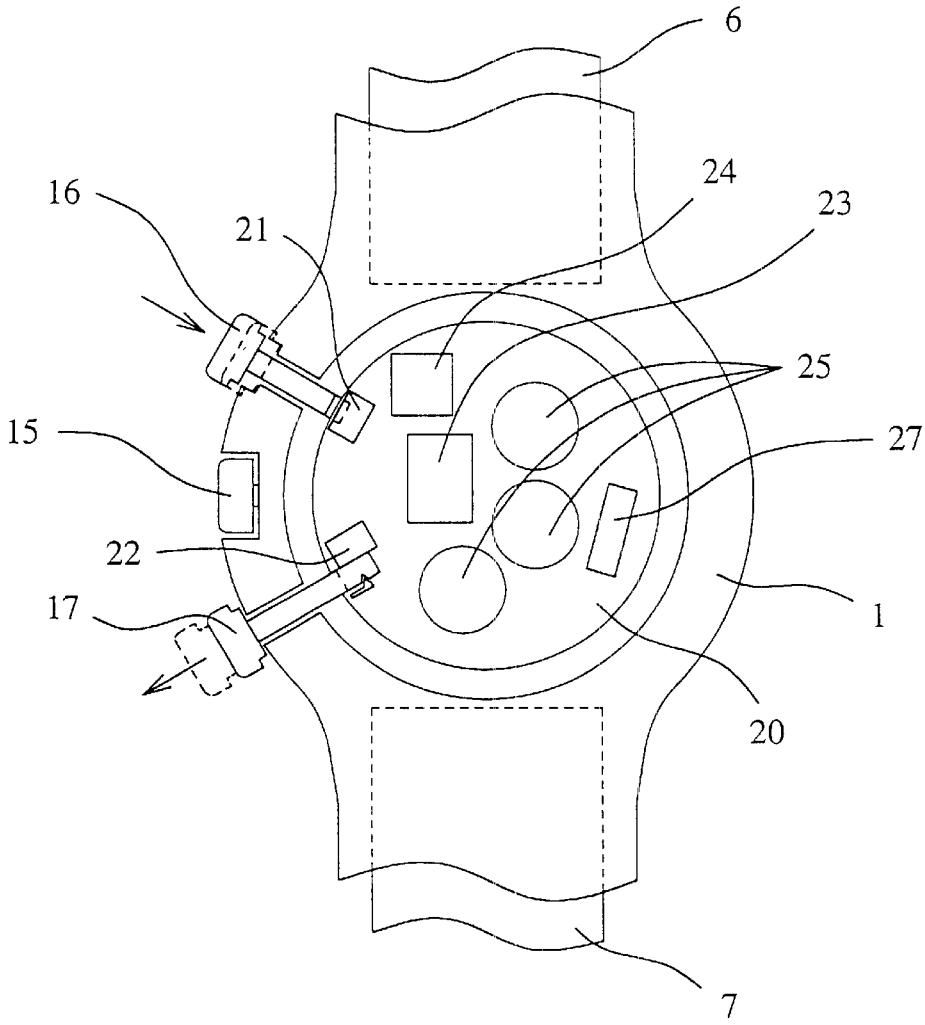
FIG. 4 is a schematic view showing an internal structure incorporated in the luminous wristwatch shown in FIG. 1.

The wristwatch of the illustrated embodiment also includes a printed board 20 arranged below the watch face 4. The printed board 20, as shown in FIG. 4, has first and second switches 21 and 22, a control section 23 for controlling flickering or on-off operation of the light emitters a in a predetermined order, a drive circuit 24 for driving the light emitters a, and a button-type cell 25 acting as a power supply.

The pushbutton 16 is so arranged that a head thereof is outwardly projected from a side surface of the watch body 1, resulting in being pushed into the watch body 1. For this purpose, the head of the pushbutton 16 is constantly outwardly urged by means of a spring. Thus, when the pushbutton 16 is forcedly pressed against the spring, it is pushed at the head thereof into the watch body 1, resulting in the first switch 21 arranged on the printed board 4 being turned on. Whereas, release of the pushbutton from the pressing force permits the first switch 21 to be turned off, so that a state of operation of the first switch 21 is inputted in the form of a signal a to the control section 23.

The pull button 17, as described above, is outwardly drawably arranged on the side surface. When the pull button 17 is outwardly drawn at a head thereof, it is outwardly projected by a predetermined distance, so that the operation state of the pull button 17 may be kept by a stabilizer (not shown) and the second switch 22 may be turned on. The second switch 22 has a sensor 27 connected in series thereto for detecting vibration applied to the wristwatch and/or inclination in position of the sensor thereof. The sensor 27 is rendered effective when the second switch 22 is kept turned on, so that a state of operation of the sensor may be inputted in the form of a signal b to the control section 23.

Figure 5:
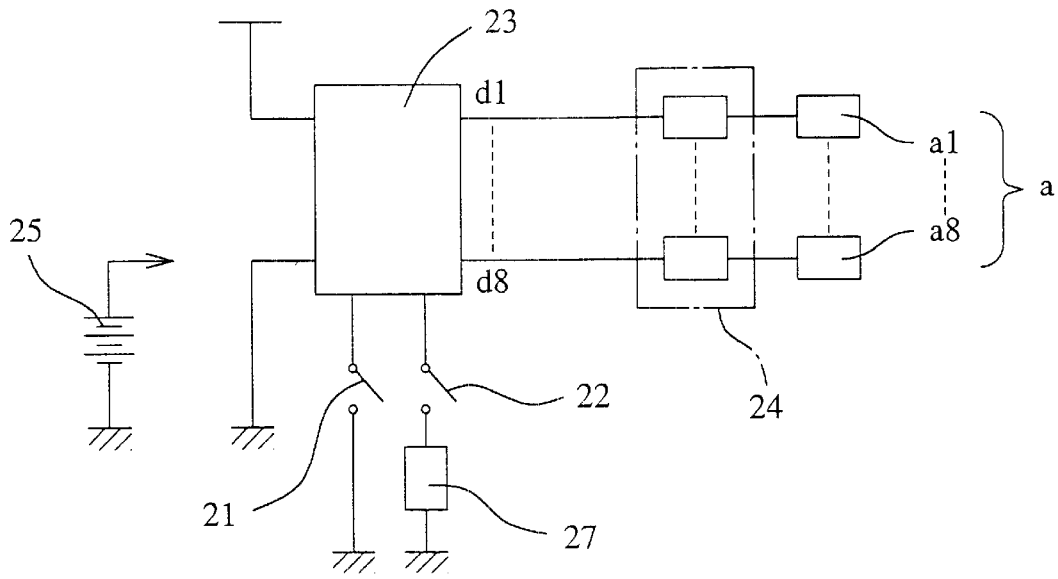
FIG. 5 is a diagrammatic view showing construction of the luminous wristwatch shown in FIG. 1.
Figure 6:
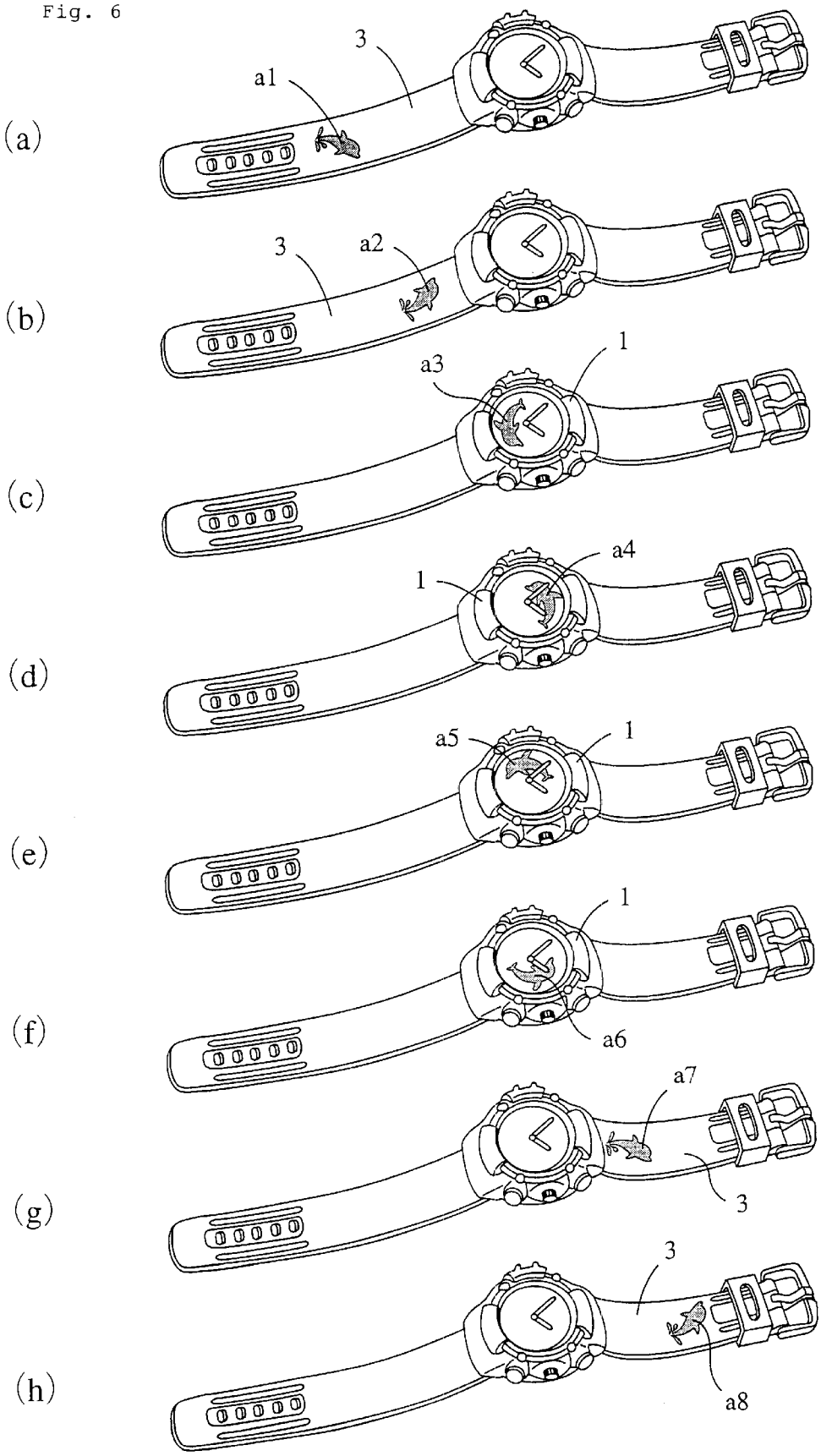
FIGS. 6A to 6H each are a perspective view showing a manner of operation of the luminous wristwatch shown in FIG. 1.
Figure 7:
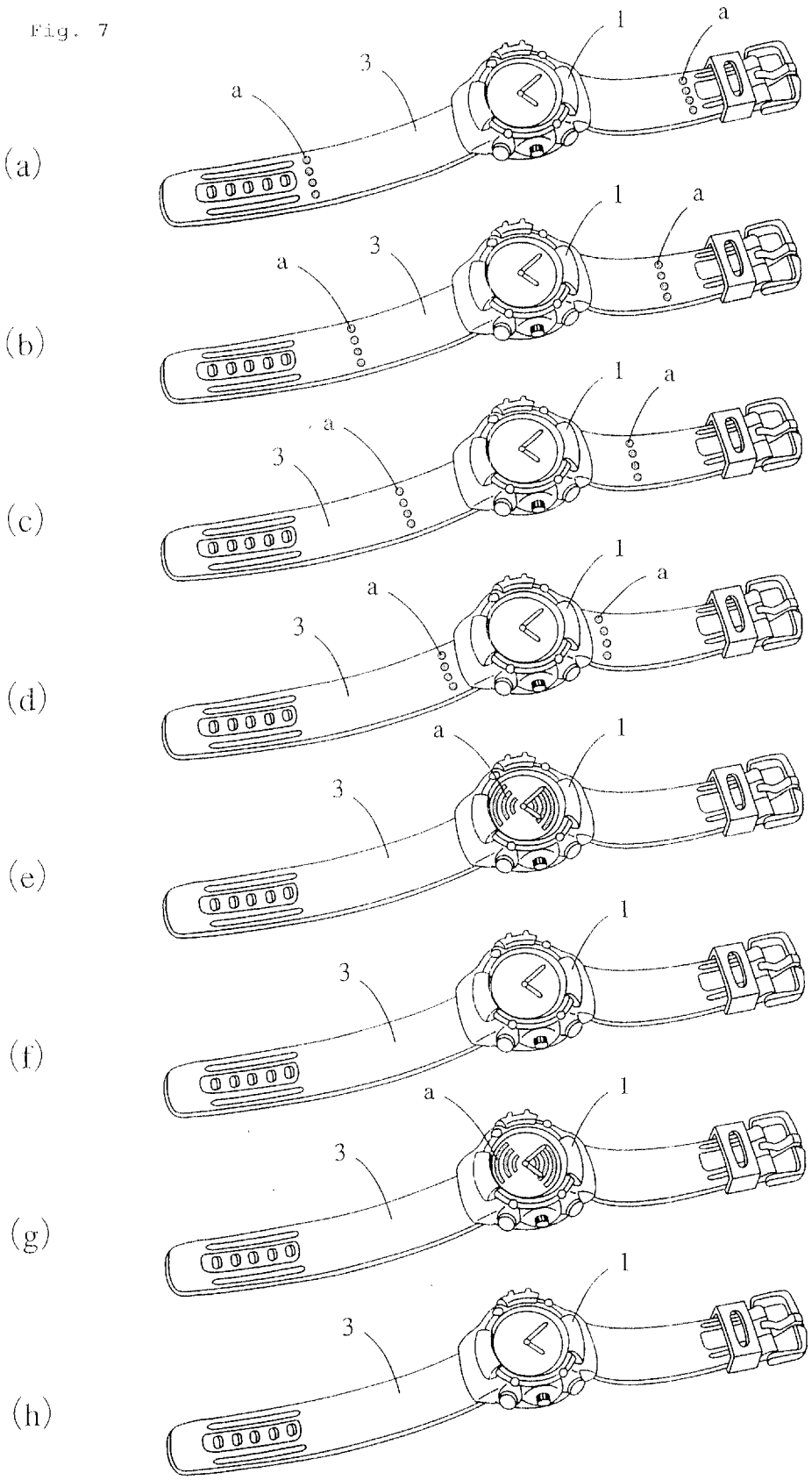
FIGS. 7A to 7H each are a perspective view showing another manner of operation of the luminous wristwatch shown in FIG. 1.

The control section 23 is constituted by a microcomputer and constructed so as to output drive signals d1 to d8 depending on the signal a or b according to a control program stored in an internal memory thereof, to thereby control on-off operation of the light emitters a1 to a8 in a predetermined order, as shown in FIG. 5.

The light emitters a each are formed of an electroluminescent material or an electroluminor. The electroluminescent material is deposited in any desired pattern or design such as, for example, a dolphin or the like on each of a rear surface of the light-permeable watch face 4 and the strip-like flexible panels 6 and 7 inserted into the slits 9 and 10 formed on the belt member 3. Thus, the microcomputer 23 outputs the drive signals d1 to d8 at predetermined timings for a predetermined period of time, so that the light emitters or electroluminescent materials a1 to a8 corresponding to the drive signals d1 to d8 emit light at predetermined timings for a predetermined period of time.

In FIG. 2, reference numeral 30 designates a rear cover and 31 is an O-ring for sealing.

Now, the manner of operation of the luminous wristwatch of the illustrated embodiment thus constructed will be described hereinafter. When the pushbutton 16 is released after being pushed, the first switch 21 is turned off or open after it is turned on or closed. Such operation of the switch 21 is inputted in the form of a signal a to the control section 23, so that the control section 23 controls luminescence of the electroluminescent materials a in a predetermined order using a timing of opening of the switch 21 as a trigger. This results in a visual display of motion as if a dolphin jumps from one end side of the belt member to the other end side thereof while turning a somersault in the wristwatch being exhibited, as shown in FIGS. 6A to 6H. When such successive display is terminated, the microcomputer 23 stops emission of the light emitters a, so that the wristwatch is ready for the next push operation of the pushbutton 16.

When the pull button 17 is pulled out, the second switch 22 connected in series to the sensor 27 is turned on or closed, so that the sensor 27 which is actuated depending on vibration applied to the wristwatch and/or inclination thereof may be rendered effective. Then, a signal b indicating such operation of the sensor 27 is inputted to the control section 23, so that the control section 23 controls luminescence of the electroluminescent materials a in a predetermined order using a timing at which the vibration and/or inclination is detected as a trigger. This permits display in motion as if a dolphin jumps from one end side of the belt member to the other end side thereof while turning a somersault in the wristwatch to be exhibited. When such successive display is terminated, the microcomputer 23 stops emission of the light emitters a, so that the microcomputer 23 is ready for the next detection of vibration and/or inclination by the sensor 27.

The sensor 27 is kept effective during the time period in which the pull button 17 is kept pull out, so that when a wearer of the wristwatch swings his or her arm or moves his or her body, the electroluminescent materials a may be permitted to emit light.

Whereas, when the pull button 17 is pushed back, the second switch 22 is turned off, to thereby render a circuit of the sensor 27 open, so that the sensor 27 may be rendered ineffective, to thereby fail to permit on-off operation of the electroluminescent materials a even when the sensor 27 detects vibration applied to the wristwatch and/or inclination thereof.

Thus, in the wristwatch of the illustrated embodiment constructed as described above, on-off operation of the pushbutton 16 permits a predetermined pattern or design to be moved from one side of the belt member through the watch body 1 to the other side of the belt member while emitting light. Also, the wrist watch, as shown in FIGS. 7A to 7H, permits a pattern formed by the electroluminescent materials a to be moved from both ends of the belt member 3 toward the watch body 1 while emitting light and to flicker in the watch body. Further, it permits the electroluminescent materials to be moved from the watch body to both ends of the belt member 3 while emitting light. Thus, the luminous wristwatch of the illustrated embodiment exhibits visual fun and a sense of play unlike a conventional luminous wristwatch in which a lamp is merely subject to on-off operation in a watch body.

Also, in the luminous wristwatch of the illustrated embodiment, drawing-out of the pull button permits detection of vibration applied to the watch body or inclination thereof, so that excitation of the electroluminescent materials and deexcitation thereof may be carried out at predetermined timings. This permits the electroluminescent materials to selectively emit light irrespective of intention of a wearer of the luminous wristwatch. Thus, the luminous wristwatch of the illustrated embodiment permits luminescence of the wristwatch on the wearer walking in the night to be visible at a relatively wide angular range from far away, to thereby ensure safety of the wearer.

Further, the luminous wristwatch of the illustrated embodiment is so constructed that the flexible panels each having the light emitters arranged thereon each are inserted into each of the slits of the belt member so as to permit the belt member to be luminous. Such construction eliminates a necessity of forming the belt member and flexible panels integrally with each other, resulting in manufacturing of the luminous wristwatch being simplified and general-purpose parts being applied to the illustrated embodiment.

As can be seen from the foregoing, the luminous wristwatch of the present invention satisfactorily exhibits a sense of play as well as practical properties, because operation of the operation button permits a plurality of light emitters arranged on the belt member and watch body to be operated, resulting in the watch face being lightened and the belt member emitting light.

Also, the present invention may be so constructed that the watch body is provided with the sensor for detecting vibration applied to the wristwatch and/or inclination thereof, as well as the control button for rendering the sensor effective. Such construction does not necessarily lead to on-off operation of the light emitters upon detection of the vibration and/or inclination. Thus, luminescence of the light emitters may be determined at any desired time in any desired place. Also, it permits on-off operation of the light emitters to be carried out as desired depending on motion of the arm of a wristwatch wearer. Therefore, the present invention permits luminescence of the wristwatch on the wearer walking in the night to be visible at a relatively wide angular range from far away, to thereby ensure safety of the wearer.

Further, the present invention may be so constructed that the light emitters each may be constituted by an electroluminescent material. This permits the light emitters to be formed into any desired configuration, so that the light emitters may be formed into a funny configuration.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A luminous wristwatch comprising:

a watch body;

a watch face; and a belt member;

said watch face and belt member each being provided with a plurality of light emitters which emit light upon feeding of a current thereto;

said watch face and belt member each being formed to be light-permeable so that light emitted from said light emitters may be externally observed therethrough;

said watch body being provided thereon with an operation button and a control section for controlling on-off operation of said light emitters upon operation of said operation button, wherein said watch body is provided with a sensor for detecting vibration applied to the wristwatch and/or inclination thereof and a control button for rendering said sensor effective;

said control section controlling on-off operation of said light emitters depending on said vibration and/or inclination during operation of said control button.

2. A luminous wristwatch as defined in claim 1, wherein said light emitters each are constituted by an electroluminescent material.

3. A light emitting wristwatch comprising:

a watch body;

a wristband connected to the watch body;

a first light emitting display connected to and integral with the wristband;

a second light emitting display connected to the watch body; and a drive unit connected to the first and second light emitting displays for activating the first and second light emitting displays whereby light emits from the wristband and the watch body.

4. The wristwatch of claim 3, wherein the first light emitting display extends on the wristband to opposite sides of the watch body.

5. The wristwatch of claim 3, wherein the wristband has a series of light indicia that are sequentially activated by the drive unit to visually provide an appearance of motion of an image along the wristband.

6. The wristwatch of claim 3 further including a motion sensor operatively connected to the drive unit wherein a predetermined movement of the motion sensor activates the first light emitting display.

7. The wristwatch of claim 5, wherein the individual light indicia can be sequentially activated to create an appearance of a light indicia image progressively moving along the wristband and across the watch body.

8. The wristwatch of claim 7, wherein the wristband has a hollow interior section and a flexible light emitting panel with predetermined indicia patterns is mounted in the interior section.

9. The wristwatch of claim 7, wherein the watch body includes a transparent face plate and the wristband is also transparent whereby the activation of the individual light indicia progresses from a distal end of the wristband to and across the face plate.

10. A light emitting wristwatch comprising:

a watch body;

a wristband having a first band member connected to the watch body and a second band member connected to the watch body, the first and second band members are connectable to encircle a wrist of a user;

a first light emitting member is mounted to the watch body with a first light indicia pattern;

a second light emitting member is mounted in the first band member with a second light indicia pattern;

a third light emitting member is mounted in the second band member with a third light indicia pattern; and a drive unit is operatively connected to respectively the first, second, and third light emitting members, whereby the light emitting members can be activated to display the light indicia patterns.

11. The wristwatch of claim 10, wherein the first, second, and third light indicia patterns are identical images.

12. The wristwatch of claim 10, wherein the second and third light emitting members are flexible panels.

13. The wristwatch of claim 12, wherein the first and second band members are transparent and have respectively hollow interior sections for mounting the flexible panels.

14. The wristwatch of claim 10, further including a motion sensor operatively connected to the drive unit, wherein a predetermined movement of the motion sensor activates the first light emitting display.

15. The wristwatch of claim 14, wherein the individual light indicia patterns can be sequentially activated to create an appearance of a light indicia image progressively moving along the wristband and across the watch body.

16. The wristwatch of claim 10, further including a manual switch operatively connected to the drive unit and mounted on the watch body to activate the respective first, second, and third light emitting members.

17. A light emitting wristwatch comprising:

a watch body;

a wristband connected to the watch body;

a first light emitting display connected to and integral with the wristband;

a drive unit connected to the first light emitting display for activating the light emitting display whereby the first light emitting display emits light from the wristband; and a motion sensor operatively connected to the drive unit wherein a predetermined movement of the motion sensor activates the first light emitting display.

18. The wristwatch of claim 17, wherein the first light emitting display extends on the wristband to opposite sides of the watch body.

19. The wristwatch of claim 17, wherein the first light emitting display on the wristband has a series of light indicia patterns that are sequentially activated by the drive unit to visually provide an appearance of motion to the light indicia along the wristband.

20. The wristwatch of claim 17, wherein the watch body has a second light emitting display connected to the drive unit and the drive unit can activate individual light indicia to cause the wristband and the watch body to emit light.

21. The wristwatch of claim 20, wherein the individual light indicia can be sequentially activated to create an appearance of a light indicia image progressively moving along the wristband and across the watch body.

22. The wristwatch of claim 21, wherein the wristband has a hollow interior section and a flexible light emitting panel with predetermined indicia patters is mounted in the interior section.

23. The wristwatch of claim 21, wherein the watch body includes a transparent face plate and the wristband is also transparent whereby the activation of the individual light indicia progresses from a distal end of the wristband to and across the face plate.

* * * * *